US006269516B1

(12) United States Patent
Saatjian et al.

(10) Patent No.: US 6,269,516 B1
(45) Date of Patent: Aug. 7, 2001

(54) WASTE REMOVER

(76) Inventors: Silva Saatjian, 4630 Sepulveda Blvd. #102, Sherman Oaks, CA (US) 91403; Lucie A. Amirayan, 17728 Collins St., Encino, CA (US) 91316

( * ) Notice: Subject to any disclaimer, the term of this patent is extended or adjusted under 35 U.S.C. 154(b) by 0 days.

(21) Appl. No.: 09/505,617

(22) Filed: Feb. 16, 2000

(51) Int. Cl.[7] ..... A47K 7/08

(52) U.S. Cl. ..... 15/210.1; 15/147.2; 15/147.1; 604/1

(58) Field of Search ..... 15/104.94, 209.1, 15/210.1, 147.1, 147.2, 154; 604/1; 294/1.4, 19.1, 61

(56) References Cited

U.S. PATENT DOCUMENTS

| | | | | |
|---|---|---|---|---|
| 2,572,178 | * | 10/1951 | Monroe et al. | 15/154 |
| 2,610,347 | * | 9/1952 | Kleiner et al. | 15/210.1 |
| 2,635,274 | * | 4/1953 | Hatcher et al. | 15/147.1 |
| 2,666,224 | * | 1/1954 | Adams | 15/210.1 X |
| 3,383,158 | * | 5/1968 | Leland | 15/210.1 X |
| 4,075,033 | * | 2/1978 | Knox et al. | 15/210.1 X |
| 4,940,454 | * | 7/1990 | Siragusa | 604/1 |
| 4,987,634 | * | 1/1991 | Weihrauch | 15/209.1 |
| 5,630,243 | * | 5/1997 | Federico et al. | 15/210.1 X |
| 5,875,512 | * | 3/1999 | Lathan | 15/210.1 |

FOREIGN PATENT DOCUMENTS

| | | | | |
|---|---|---|---|---|
| 231213 | * | 7/1959 | (AU) | 15/210.1 |

* cited by examiner

*Primary Examiner*—Mark Spisich
(74) *Attorney, Agent, or Firm*—Blakely, Sokoloff, Taylor and Zafman

(57) ABSTRACT

A waste remover of human waste is disclosed. The waste remover comprises a remover member and a moveable member. The moveable member is located in a tube. The tube is also coupled to a head. A remover member extends from the head.

6 Claims, 10 Drawing Sheets

WASTE REMOVER

FIELD OF THE INVENTION

This invention relates generally to waste removal, and more specifically to removing human waste.

BACKGROUND

Humans release waste in the form of fecal matter and/or urine. Conventionally, individuals use paper such as toilet paper to remove waste residue located on their genital and/or rectal areas. However, there are some individuals who are incapable of using this conventional means. For example, individuals who have back, neck, and spinal cord problems or are extremely obese have difficulty performing this task. As a result, some individuals must seek assistance from others. This causes some individuals embarrassment and a sense of loss of dignity. Accordingly, it is desirable to have a tool that will allow these individuals to perform this task in the privacy of their own home, or in convalescent homes, hospitals, or any other location.

SUMMARY

A waste remover of human waste is disclosed comprising a tube coupled to a moveable member and to a head.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

The following detailed description and accompanying drawings are provided for the purpose of describing and illustrating presently preferred embodiments of the invention only and are not intended to limit the scope of the invention.

Figure 1:
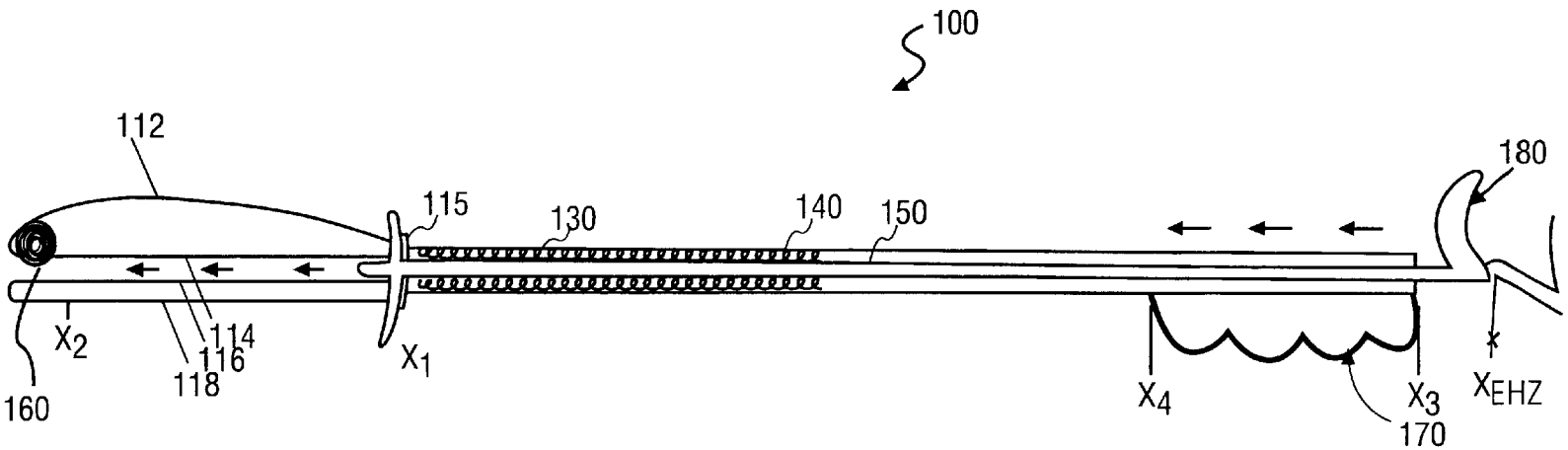
FIG. 1 illustrates a cross-sectional view of a waste remover in accordance with one embodiment of the invention.

FIG. 1 illustrates a cross-sectional view of waste remover 100 in accordance with one embodiment of the invention. Waste remover 100 includes a tube 130 coupled to moveable member 150 and to head 110. Tube 130 has a length of approximately 1.25 feet to 3 feet. Preferably, the tube is approximately 1 foot 4 inches. The moveable member 150 is located within tube 130. Moveable member 150 has a proximal end and a distal end. Moveable member 150 has a length that ranges from approximately 1.25 feet to 3 feet. Preferably, the moveable member 150 and tube 130 are 16.5 inches in length. The distal end is located near head 110. The distal end of moveable member 150 has a remover member in the form of a cross 120.

Figure 2:
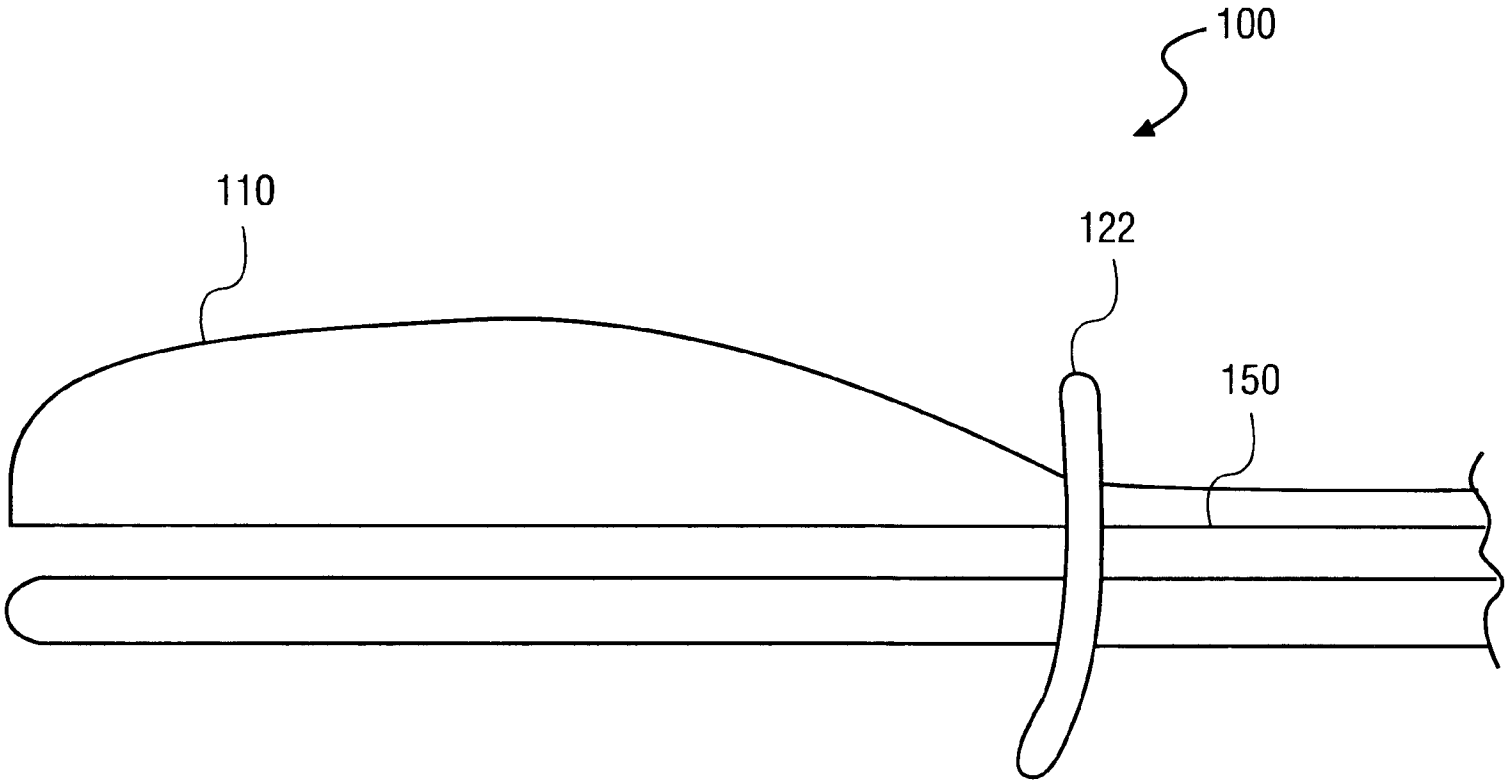
FIG. 2 illustrates a cross-sectional view of a head with a single vertical member extending from a moveable member in accordance with one embodiment of the invention.
Figure 3:
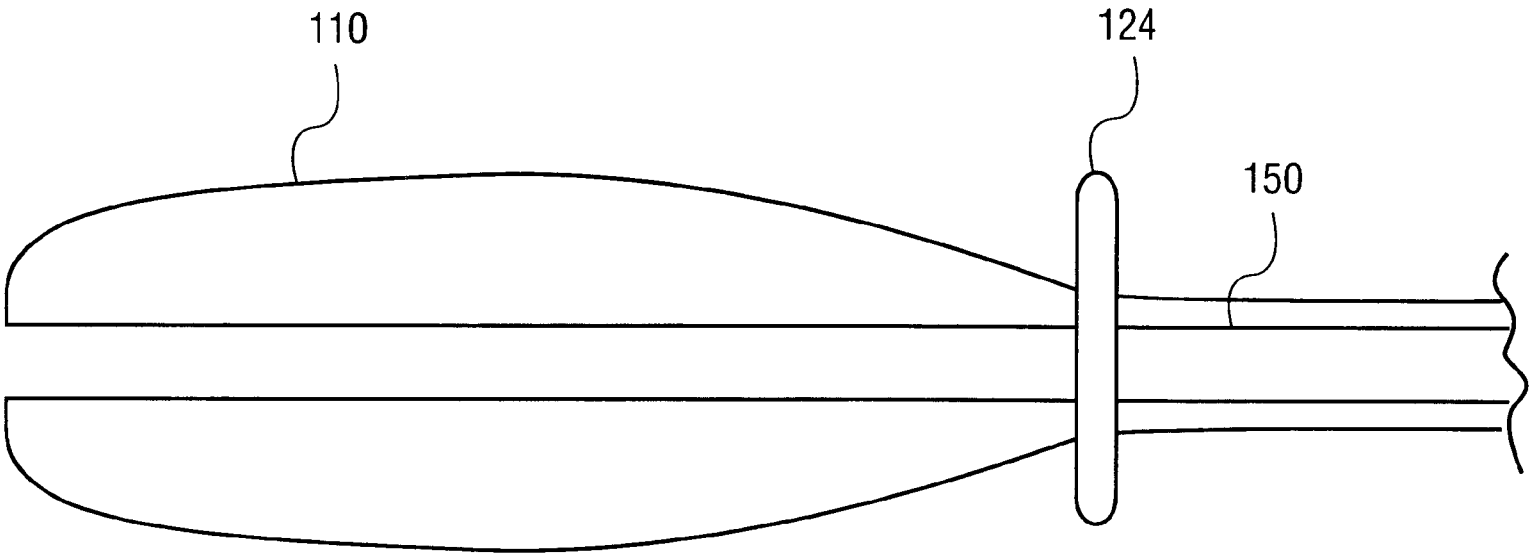
FIG. 3 illustrates a top view of a head with a single remover member extending from a moveable member in accordance with one embodiment of the invention.

Remover member such as cross 120 may be formed from a single integral piece of moveable member 150 or it may be formed as a separate piece that is coupled to the distal end of moveable member 150. It will be appreciated that although the distal end has a cross-like shape in this embodiment, other shapes may be used. For example, one of the bars of the cross may be used as shown in FIGS. 2 and 3.

A coil or spring 140 surrounds moveable member 150. Coil 140 extends from the distal end of moveable member 150 to approximately a midpoint of moveable member 150. Coil 140 compresses within tube 130 when ejector handle 180 is moved from its original resting position such as $X_{EH1}$ to position $X_{EH2}$. Coil 140 stays in position $X_{EH2}$ until the person releases the ejector handle 180. Ejector handle 180 is released when the person has completed the task of removing waste from his or her genital or rectal area. Coil 140 then assists moveable member 150 to return to its original position of $X_{EH1}$ by way of a spring-loaded action. It will be appreciated that waste remover 100 may operate without coil 140. In this embodiment, moveable member 150 slides along tube 130 until the paper slides off of head 110.

Figure 8:
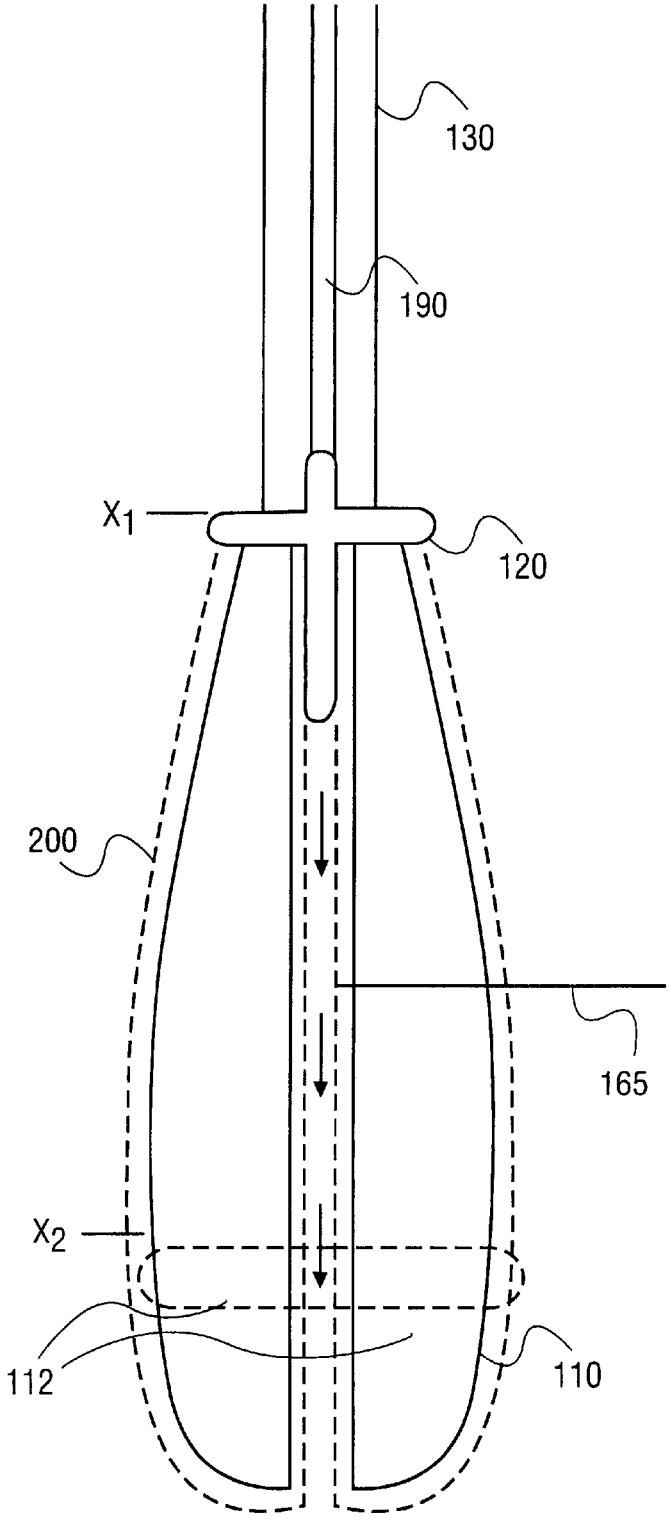
FIG. 8 shows a top view of the waste remover in accordance with one embodiment of the invention.

FIGS. 2–5 are described in reference to the top view of head 110 shown in FIG. 8. At the distal end of tube 130, head 110 is secured thereto. Head 110 has a top half and a bottom half. The top half is substantially curved on the outer portion of the top half. The lower half is substantially straight.

Figure 4:
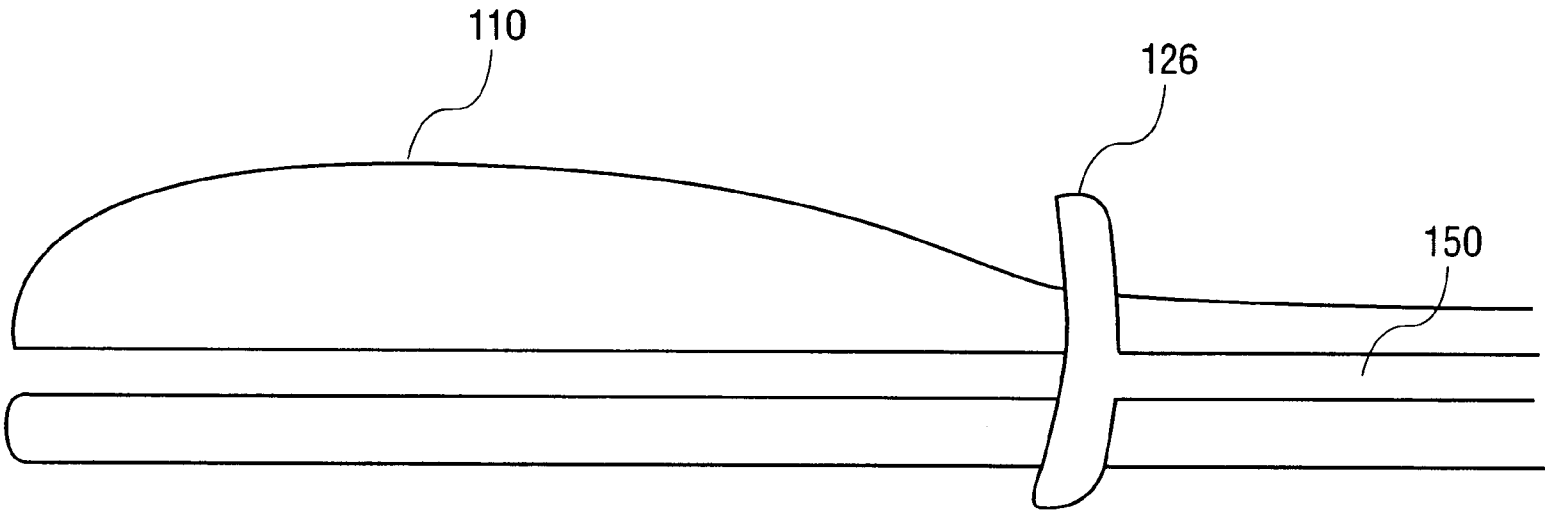
FIG. 4 illustrates a cross-sectional view of a head with a half of one remover member extending vertically from the moveable member in accordance with one embodiment of the invention.
Figure 5:
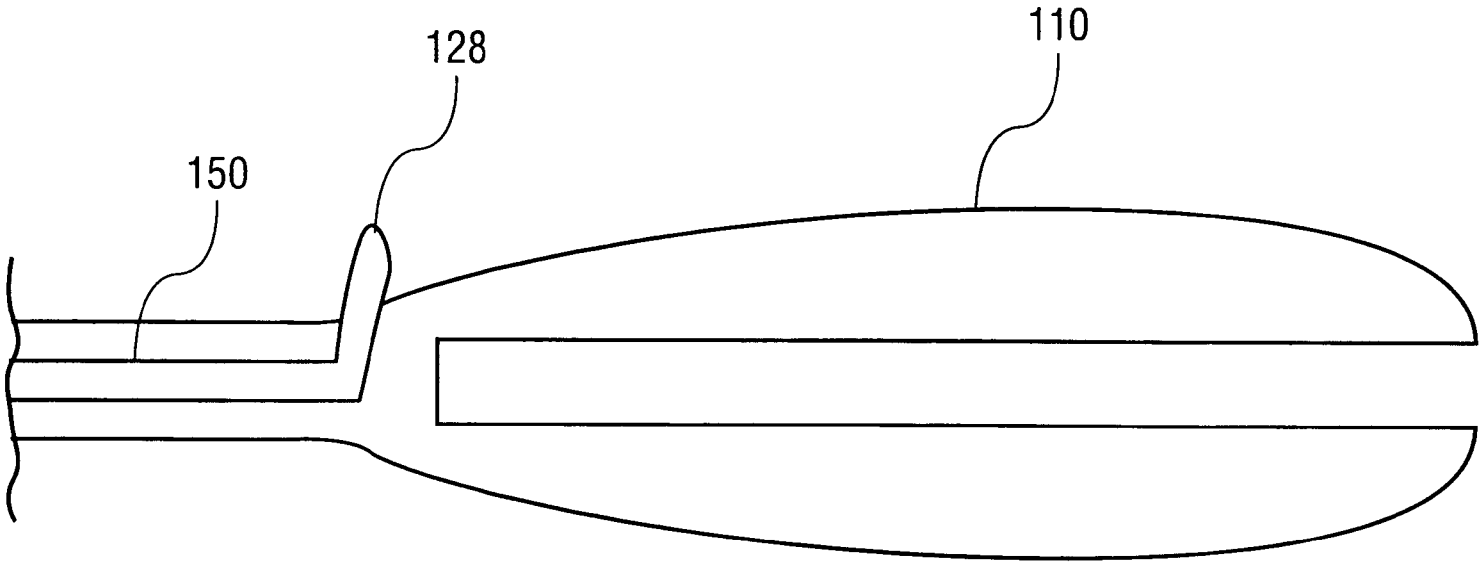
FIG. 5 illustrates a top view of a head with one half of one remover member extending from a moveable member in accordance with one embodiment of the invention.

The top half has a first side 112 and a second side 114. Similarly, the bottom half has a first side 116 and a second side 118. Head 110 further comprises a first channel 160 and a second channel 165 shown in FIG. 4. First channel 160 and second channel 165 are configured to receive a remover member such as a remover member in a substantially cross-like shape. Cross 120 enters first channel 160 and second channel 165 at the same time. Cross 120 of moveable member 150 is capable of entering both channels at the same time because, in this embodiment, head 110 is formed from a single integral piece. Accordingly, the top half and the bottom half of head 110 join together at base 115 of head 110. FIG. 2 illustrates a cross-sectional view of a portion of waste remover 100 with a single remover member extending from moveable member 150 and protruding from second channel 165 in head 110 shown in FIG. 8. FIG. 3 illustrates a top view of head 110 wherein a single horizontal remover member 124 extends from moveable member 150 horizontally and first channel 160. FIG. 4 illustrates a cross-sectional view of head 110 with a half of one remover member 126 extending vertically from channel 165 shown in FIG. 8. FIG. 5 illustrates one half of one remover member 128 extending from movable member 150. It will be appreciated that a remover member may be cylindrical, rectangular, or other suitable shape. The head may have a circumference of approximately 4 to 10 inches. Preferably, head 110 has a circumference of 5 inches. Alternatively, one-half of the remover members in various shapes may be used as shown in FIGS. 4 and 5. However, it is preferable that a substantially cross-like shape be used in order to ensure all of the paper is removed from head 110.

FIG. 1 further illustrates that waste remover 100 further comprises a handle 170 located at the proximal end of tube 130. Handle 170 allows a person to grip and easily hold waste remover 100. Ejector handle 180 is located at the proximal end of moveable member 150. Ejector handle 180 may take a variety of shapes such as a substantially square shaped handle, a substantially spherical shaped handle, a substantially T-shaped handle, or any other suitable shape.

Waste remover 100 may be formed using a variety of materials. For example, tube 130 may comprise a polymeric compound such as a vinyl or plastic or a metallic material such as aluminum, steel, copper, etc. Preferably, tube 130 comprises plastic. Moveable member 150 may also be comprised of a variety of materials. For example, moveable member 150 may be formed from a polymeric compound such as plastic or a metallic material such as copper, aluminum, steel, or other suitable material. Preferably, moveable member 150 is made up of plastic since this material is lighter in weight and less likely to cause physical harm to a person.

Figure 6:
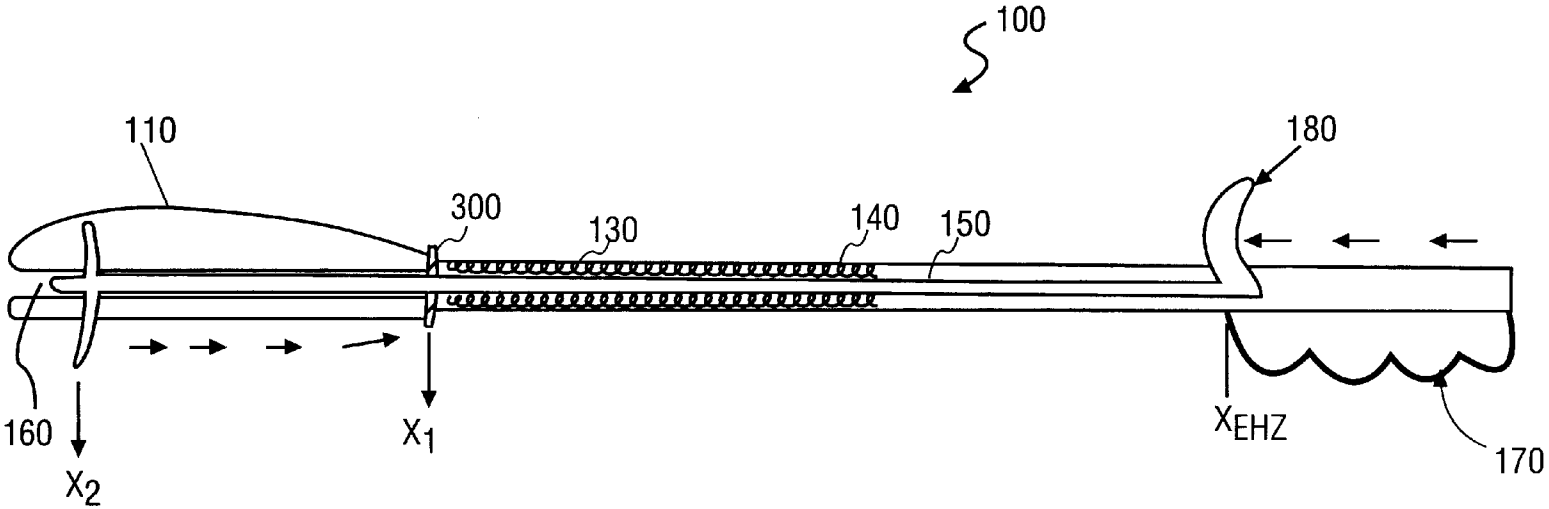
FIG. 6 illustrates the same waste remover as in FIG. 1 except the remover member has moved from position $X_1$ to position $X_2$ by the ejector handle moving from position $X_{EH1}$ to $X_{EH2}$.

FIG. 6 illustrates the same waste remover 100 as in FIG. 1 except the remover member 120 has moved from position $X_1$ to position $X_2$ by ejector handle 180 moving from position $X_{EH1}$ to $X_{EH2}$. Ejector handle 180 is capable of moving from $X_{EH1}$ to $X_{EH2}$ by the person gripping handle 170 with one hand and using the other hand to move ejector handle 180 in the distal direction.

FIG. 6 further shows a rotating member 300 that allows the top half of head 110 to rotate from a first position which may be adjacent to the genital or rectal area to a second position wherein the bottom half of head 110 may be adjacent to the genital or rectal area. In this manner, a person may remove waste using the toilet paper on the top half of head 110 and then rotating the head 110 to allow the person to use the toilet paper on the bottom half of head 110.

Figure 7:
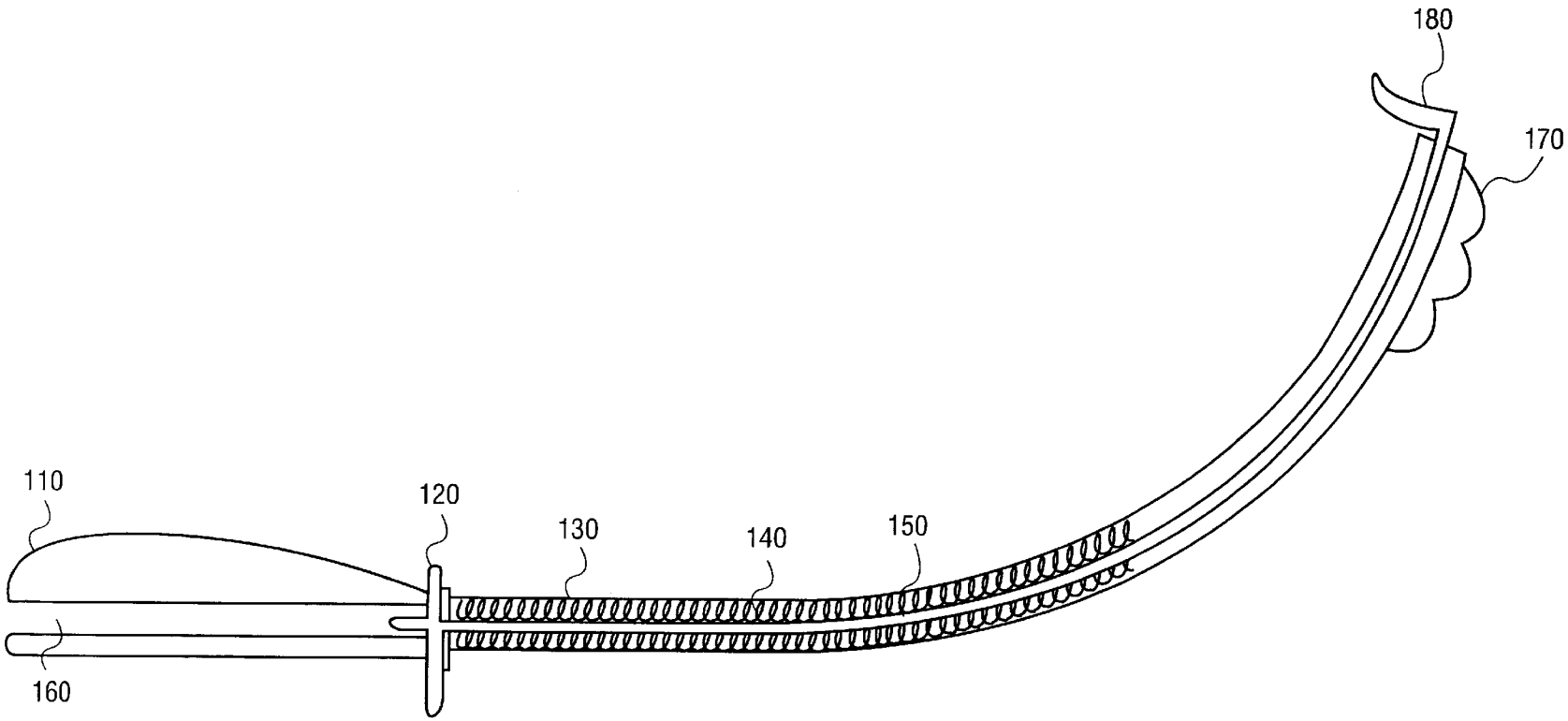
FIG. 7 illustrates the waste remover of FIGS. 1 and 6 except the proximal portion of the tube is flexibly bent in an upward direction.

FIG. 7 illustrates the waste remover 100 of FIGS. 1 and 6 except tube 130 is flexibly bent in an upward direction. The flexibility of tube 130 and member 150 is dependent upon the materials chosen to form tube 130 and member 150. Although waste remover 100 may be made of rigid materials such as metallic materials (e.g., copper, aluminum, steel, etc.), it is preferable that waste remover 100 comprises a plastic or plastic-like material.

FIG. 8 shows a top view of waste remover 100 in accordance with one embodiment of the invention. Top half of head 110 shows a first side 112 having a first portion that is symmetrical and opposed to a second portion. It will be appreciated that the first portion does not have to be symmetrical to the second portion of the top half of head 110.

Cover 200, comprised of a material such as plastic, may surround head 110 in order to protect head 110 from becoming contaminated with waste residue. It will be appreciated that cross 120 is located at position $X_1$ after cover 200 surrounds head 110 and the person has placed toilet paper over cover 200. The amount of toilet paper that is used to wrap around head 110 is approximately 8 sheets or more. The person then places head 110 close to their genital or rectal area and contacts the genital or rectal area with the toilet paper and cover 200 over head 110. The person then advances head 110 over the surface area of the genital or rectal area to remove waste material. This may entail a forward, backward, or side-to-side-like movement. After the person has completed this task, waste remover 100 may be moved such that the distal end of head 110 is positioned over a waste receptacle unit such as a toilet. The person then uses the ejector handle 180 as shown in FIGS. 1 and 6–7 and pushes ejector handle 180 in the distal direction. This results in cross 120 moving in the distal direction of head 110 until cross 120 reaches position $X_2$. The movement of cross 120 from position $X_1$ to $X_2$ results in cover 200 and the toilet paper moving off of head 110 and dropping into the waste receptacle unit (e.g. toilet).

Figure 9A:
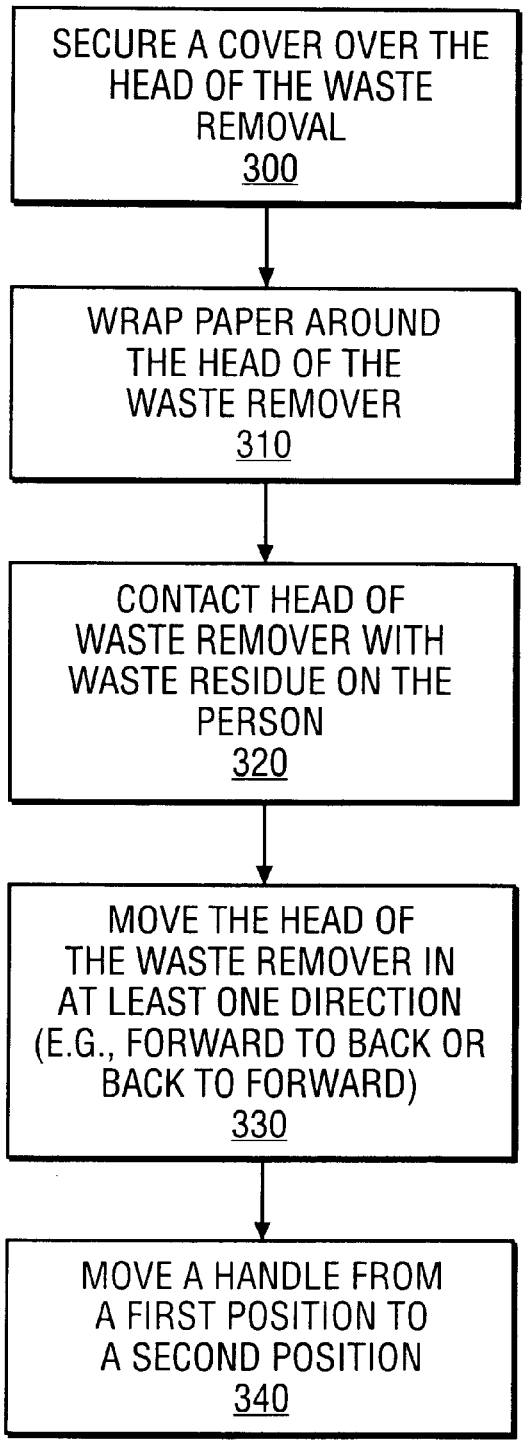
FIGS. 9A–9B illustrate a method of removing waste in accordance with one embodiment of the invention.
Figure 9B:
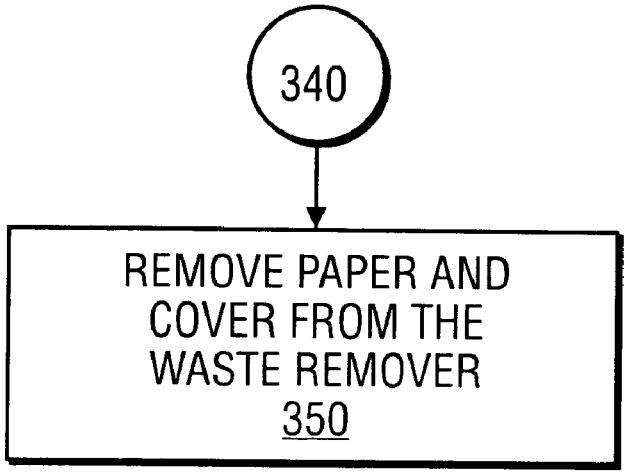

FIGS. 9A and 9B illustrate a flow chart in accordance with one embodiment of the invention. At operation 300, a cover, such as a plastic cover, is placed over the head of the waste remover. Because the top half and the lower half of head 110 further split into two portions, the cover is partitioned into portions such that it has four receiving areas somewhat like four fingers. Alternatively, the cover may be configured such that it receives the two partitions of the top portion and the bottom portion. Preferably, the cover is shaped to receive the four fingers. At operation 310, paper such as toilet paper is wrapped around the head 110 of the waste remover 100. At operation 320, the head 110 of the waste remover 100 contacts the waste residue on the person. At operation 330, the person moves the head of the waste remover in at least one direction such as in a forward to back direction or a back to forward direction in the area where the waste is located. At operation 340, a handle such as the ejector handle described above moves from the first position to a second position. This causes the cross described above to move through two channels located in the head of the waste remover. By moving through at least one channel of the head 110, the cross is able to push the cover and the toilet paper off of the head 110 of the waste remover 100.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. A remover of human waste comprising:

an elongated tube having a distal end and a proximal end, a head is coupled to the distal end of the tube;

a moveable member is coaxially nestled in the tube, the moveable member has a proximal end and a distal end;

a remover member, disposed at the distal end of the moveable member, has a cross-shape to remove waste paper located around the head;

the head includes a top half and a bottom half, the top half and the bottom half have a first channel and a second channel configured to receive the remover member.

2. The waste remover of claim 1, wherein the head has a cover.

3. The waste remover of claim 2, wherein the cover is plastic.

4. The remover of claim 1, wherein a cover surrounds the head.

5. The remover of claim 1, wherein paper is wrapped around at least one of the first channel and the second channel of the top half and the lower half of the head.

6. A remover of human waste comprising:

an elongated tube having a distal end and a proximal end;

a head extending from the distal end of the tube;

a moveable member is coaxially nestled in the tube;

the moveable member having a proximal end and a distal end;

a remover member, disposed at the distal end of the moveable member, has a cross-shape to remove waste paper located around the head;

the head includes a top half and a bottom half, the top half and the bottom half have a first channel and a second channel configured to receive the remover member.

* * * * *